US007971869B2

(12) United States Patent
Lee et al.

(10) Patent No.: US 7,971,869 B2
(45) Date of Patent: Jul. 5, 2011

(54) PRINTING MEDIA SUPPLY DEVICE FOR IMAGE FORMING APPARATUS

(75) Inventors: Jin-soo Lee, Suwon-si (KR); Yu-man Kim, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 399 days.

(21) Appl. No.: 11/384,311

(22) Filed: Mar. 21, 2006

(65) Prior Publication Data

US 2007/0045937 A1 Mar. 1, 2007

(30) Foreign Application Priority Data

Aug. 31, 2005 (KR) ..... 10-2005-0080824

(51) Int. Cl.
*B65H 3/06* (2006.01)

(52) U.S. Cl. ..... 271/120

(58) Field of Classification Search ..... 271/119, 271/120

See application file for complete search history.

(56) References Cited

U.S. PATENT DOCUMENTS

| | | | | |
|---|---|---|---|---|
| 4,084,807 | A * | 4/1978 | Terajima et al. | 271/119 |
| 5,326,184 | A * | 7/1994 | Shibata | 400/624 |
| 5,660,489 | A * | 8/1997 | Ishii et al. | 400/641 |
| 5,695,182 | A * | 12/1997 | Sekine | 271/9.09 |
| 6,502,817 | B2 * | 1/2003 | Kawaguchi | 271/164 |
| 7,111,840 | B2 * | 9/2006 | Miyamoto | 271/119 |
| 2004/0195757 | A1 * | 10/2004 | Lyu et al. | 271/110 |

FOREIGN PATENT DOCUMENTS

| | | |
|---|---|---|
| JP | 53-078926 | 12/1978 |
| JP | 60-072439 | 5/1985 |
| JP | 60-151859 | 10/1985 |
| JP | 62-77154 | 5/1987 |
| JP | 62-103548 | 7/1987 |
| JP | 62-224719 | 10/1987 |
| JP | 1-72519 | 5/1989 |
| JP | 04-286554 | 10/1992 |
| JP | 08-099731 | 4/1996 |
| JP | 09-052633 | 2/1997 |
| JP | 10-195246 | 7/1998 |
| JP | 2002-087622 | 3/2002 |
| JP | 2004-307183 | 11/2004 |

* cited by examiner

*Primary Examiner* — Michael C McCullough

(74) *Attorney, Agent, or Firm* — Roylance, Abrams, Berdo & Goodman, L.L.P.

(57) ABSTRACT

A printing media supply device for use in an image forming apparatus includes a printing media supply cassette adapted to receive a stack of printing media. A pick-up roller picks up the printing media stacked in the printing media supply cassette. The pick-up roller has a pick-up member for picking up the printing media, and a rotation member for supporting the pick-up member. The rotation member has a buffer surface formed by cutting a portion of a leading edge portion thereof away. The buffer surface may be formed so as to expose side surfaces of the pick-up member. The pick-up roller applies a substantially uniform pressure to the printing media even when there is a large quantity of printing media stacked in the printing media supply cassette, and thereby minimizes multifeeding of the printing media. Accordingly, the supply of printing media is stable, improving the printing media supply efficiency.

18 Claims, 9 Drawing Sheets

PRINTING MEDIA SUPPLY DEVICE FOR IMAGE FORMING APPARATUS

This application claims the benefit under 35 U.S.C. §119 (a) of Korean Patent Application No. 2005-80824, filed Aug. 31, 2005, in the Korean Intellectual Property Office, the entire contents of which are hereby incorporated by reference.

BACKGROUND OF THE INVENTION

1. Field of the Invention

The present invention relates to an image forming apparatus. More particularly, the present invention relates to a printing media supply device for an image forming apparatus, which is capable of preventing multifeeding (that is, transferring several printing media into a main body of an image forming apparatus at one time) when the printing media in a printing media supply cassette is picked up.

2. Description of the Related Art

In general, an image forming apparatus includes a printing media supply device for supplying printing media, such as paper, fabric, film or the like, into a main body of the apparatus. Such a printing media supply device typically has a separate pick-up roller to pick up the printing media sheet by sheet.

One example of a printing media supply device of a conventional image forming apparatus is schematically shown in FIGS. 1 and 2. As shown in FIG. 1, a printing media supply device 100 includes a printing media supply cassette 110 having a space in which the printing media P is stacked, and a pick-up roller 120 which picks up the printing media P stacked in the printing media supply cassette 110 sheet by sheet to supply the printing media into the main body of the image forming apparatus.

As shown in FIG. 2, the printing media supply cassette 110 includes a base plate 111 detachably installed in a main body 1 of the image forming apparatus, and a stack of printing media P is stacked on the base plate 111. A first elastic member 112 pushes up one side of the base plate 111, and fingers 113 are installed at both side of the end of the base plate 111. The fingers 113 are interlocked with the base plate 111 so as to hinder movement of the printing media P and thus cause them to be supplied sheet by sheet.

The pick-up roller 120 is installed in an upper portion of the printing media supply cassette 110 to contact the printing media P stacked in the printing media supply cassette 110. The pick-up roller 120 has a pick-up member 121 for picking up the printing media P and a rotation member 122 coupled with a rotation shaft 123 while supporting the pick-up member 121.

The pick-up member 121 is provided on the rotation member 122, which is brought into contact with the printing media P, and exerts pressure on the printing media P. The pick-up member 121 is formed of, for example, a rubber material with a high elasticity to increase the frictional force on the printing media P. Further, on an outer circumferential surface of the pick-up member 121, saw-teethed protrusions 121*a* (see FIGS. 3A and 3B) are formed to increase the frictional force on the printing media P. Therefore, the pick-up member 121 picks up the printing media P by the frictional force generated when it is brought into contact with the printing media P and supplies them into the main body 1.

FIGS. 3A and 3B are views illustrating a process of feeding printing media by the pick-up roller. When a signal to pick up the printing media P is received from the image forming apparatus, a leading edge portion 122*b* of the pick-up roller 120 is first brought into contact with the printing media P, as shown in FIG. 3A, so that the printing media P is pressed in a direction indicated by the arrow A. Then, as shown in FIG. 3B, when the pick-up roller 120 is rotated in a direction indicated by the arrow B, the pick-up member 121 is brought into contact with the printing media P. The pick-up member 121 contacts the printing media P and transfers the uppermost printing media P in a direction indicated by the arrow C by frictional force, and supplies it into the main body 1 of the image forming apparatus.

In this process of feeding printing media, however, the pressure exerted on the top-most printing medium by the pick-up roller varies depending on the amount of printing media stacked in the printing media supply cassette. FIG. 4 is a view illustrating the operation of the printing media supply device shown in FIG. 1, depending on the amount of printing media. Referring to the drawing, the slope of the upper surface of the printing media P is closer to horizontal when the amount of printing media P is large (shown in solid lines) than when the amount of printing media is small (shown in dotted lines). Therefore, the pick-up roller 120 is brought into contact with the printing media P faster in the former case than in the latter case, so that the compression of the first elastic member 112 increases and the pressure exerted on the printing media P by the pick-up roller 120 increases. Accordingly, although the fingers 113 (that is, devices for separating the printing media) are installed in the conventional printing media supply cassette 110, there is a possibility of multifeeding because of the increased pressure exerted on the printing media P by the pick-up roller 120.

Accordingly, there is a need for an improved printing media supply device which is capable of preventing multifeeding regardless of the amount of printing media stacked in a printing media supply cassette.

SUMMARY OF THE INVENTION

An aspect of the present invention is to address at least the above problems and/or disadvantages and to provide at least the advantages described below. Accordingly, an aspect of the present invention is to provide a printing media supply device for use in an image forming apparatus, which is capable of preventing multifeeding (that is, feeding several printing media into a main body of an image forming apparatus at one time) regardless of the amount of printing media stacked in a printing media supply cassette when the printing media are picked up.

In accordance with an aspect of the present invention, a printing media supply device for use in an image forming apparatus includes a printing media supply cassette in which printing media is stacked, and a pick-up roller which picks up the stacked printing media. The pick-up roller comprises a pick-up member for picking up the printing media, and a rotation member for supporting the pick-up member which is connected to a rotation shaft. The rotation member has a buffer surface at a leading edge portion.

The printing media supply cassette may include a base plate on which the printing media is stacked, a first elastic member for pushing up one portion of the base plate, and a pair of fingers which are mounted at both ends of the base plate to be interlocked with the base plate so as to hinder movement of the printing media, so that the printing media is transferred sheet by sheet.

The pick-up member may be provided with a plurality of protrusions formed along an outer circumferential surface. The pick-up member may be formed of a rubber material. The pick-up member may be formed into a band shape. An inner circumferential surface of the pick-up member near a leading edge portion thereof may be formed into a wavy shape, or the pick-up member may be provided with a void formed at a leading edge portion therein. A predetermined space may be formed between the pick-up member and the rotation member, near the leading edge portion of the rotation member.

The rotation member may have a first rotation member and a second rotation member which is disposed to face the first rotation member, and which is provided with a support plate supporting the pick-up member.

The buffer surface of the rotation member may be formed so as to expose side surfaces of the pick-up member, and formed such that side surfaces of the pick-up member become more exposed as they approach the leading edge portion of the pick-up roller.

In accordance with another aspect of the present invention, a printing media supply device for use in an image forming apparatus includes a printing media supply cassette in which a number of printing media are stacked, and a pick-up roller which picks up the printing media stacked in the printing media supply cassette. The pick-up roller has a pick-up member for picking up the printing media, a movable member mounted to a rotation shaft to support the pick-up member, and a rotation member which is disposed on both side surfaces of the movable member to be mounted to the rotation shaft. A second elastic member is disposed at a rear portion of the rotation member to press the pick-up member.

The rotation member may have a first rotation member, and a second rotation member which is disposed to face the first rotation member, and which is provided with a support plate at a rear end portion. The support plate of the second rotation part may be provided with a protrusion part onto which the second elastic member is inserted.

BRIEF DESCRIPTION OF THE DRAWINGS

The above and other objects, features, and advantages of certain exemplary embodiments of the present invention will be more apparent from the following description taken in conjunction with the accompanying drawings, in which:

FIGS. 6A to 6C are detailed views of the pick-up roller of the printing media supply device shown in FIG. 5, wherein FIG. 6A is a front view of the pick-up roller, FIG. 6B is an exploded perspective view of the pick-up roller, and FIG. 6C is side view of the pick-up roller, in an assembled state;

FIGS. 9A and 9B are front views showing the operation of the pick-up roller in accordance with the first exemplary embodiment of the present invention, wherein FIG. 9A illustrates a situation where there is a small amount of printing media and FIG. 9B illustrates a situation where there is a large amount of printing media;

FIGS. 11A to 11C are detailed views of the pick-up roller of the printing media supply device shown in FIG. 10, wherein FIG. 11A is a front view of the pick-up roller, FIG. 11B is an exploded perspective view of the pick-up roller, and FIG. 11C is a side view of the pick-up roller, in an assembled state; and FIGS. 12A and 12B are front views illustrating the operation of the pick-up roller in accordance with the fourth exemplary embodiment, wherein FIG. 12A illustrates a case where a situation where there is a small amount of printing media and FIG. 12B illustrates a situation where there is a large amount of printing media.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

A printing media supply device for use in an image forming apparatus in accordance with the present invention will now be described, with reference to the accompanying drawings.

First to Third Exemplary Embodiments

Figure 1:
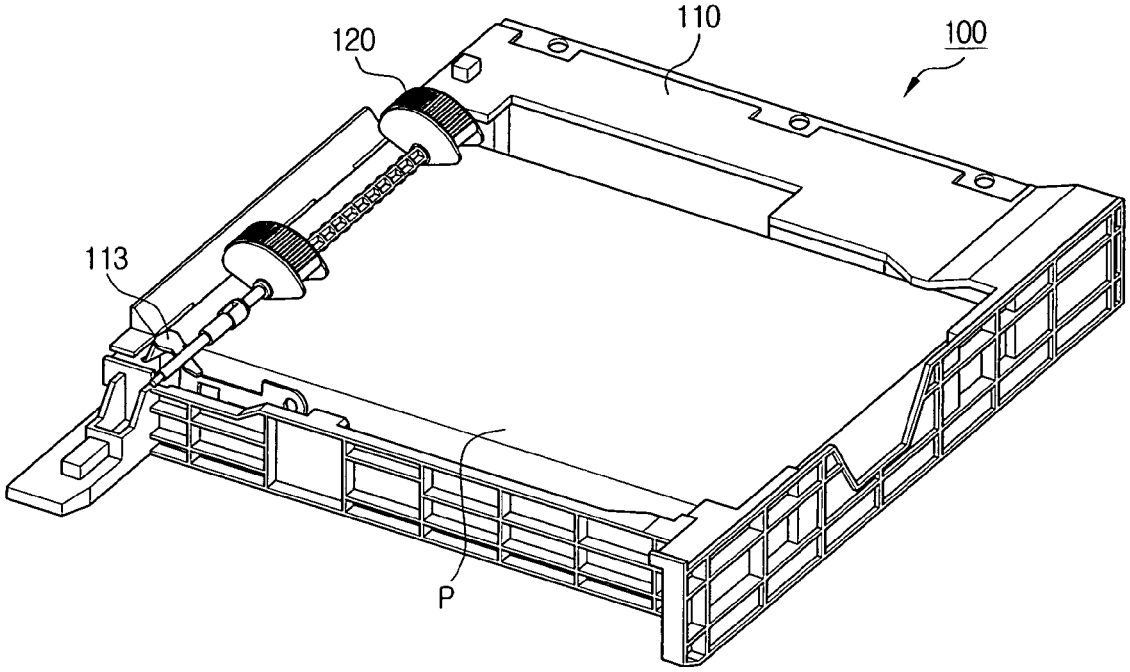
FIG. 1 (PRIOR ART)
FIG. 1 is a perspective view of a printing media supply device of a conventional image forming apparatus.
Figure 2:
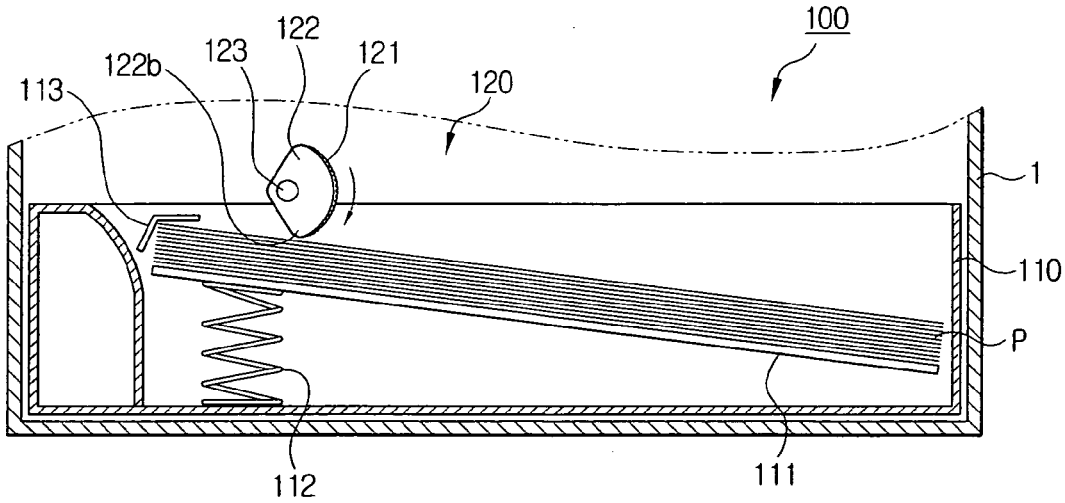
FIG. 2 (PRIOR ART)
FIG. 2 is a schematic cross sectional view of the printing media supply device shown in FIG. 1.
Figure 3A:
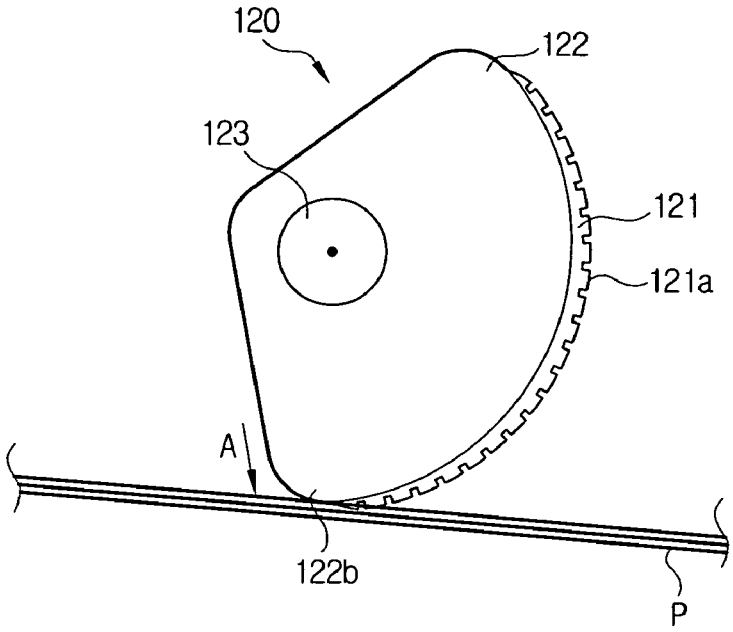
FIG. 3A (PRIOR ART)
FIGS. 3A and 3B are front views showing the operation of the pick-up roller shown in FIG. 1.
Figure 3B:
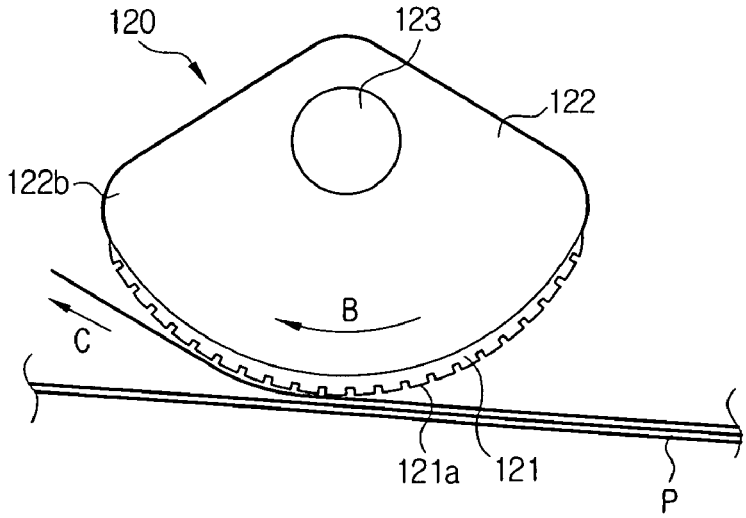
FIG. 3B (PRIOR ART)
Figure 4:
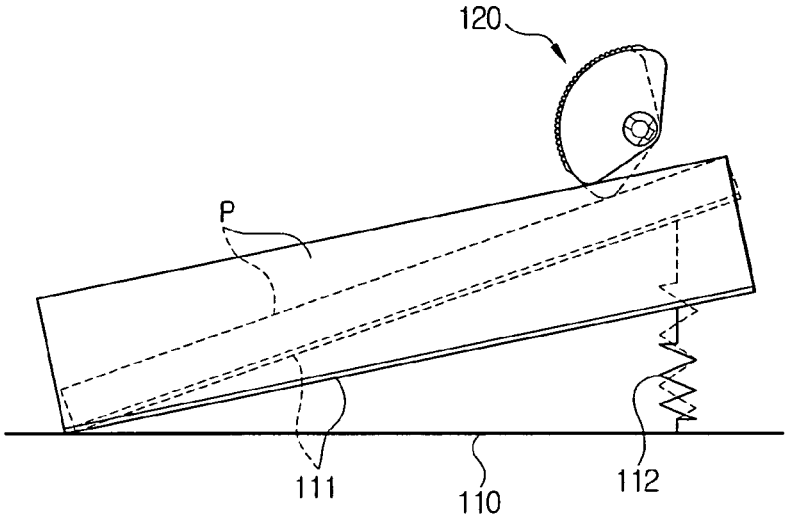
FIG. 4 (PRIOR ART)
FIG. 4 is a front view showing the operation of the printing media supply device shown in FIG. 1, depending on the amount of printing media.
Figure 5:
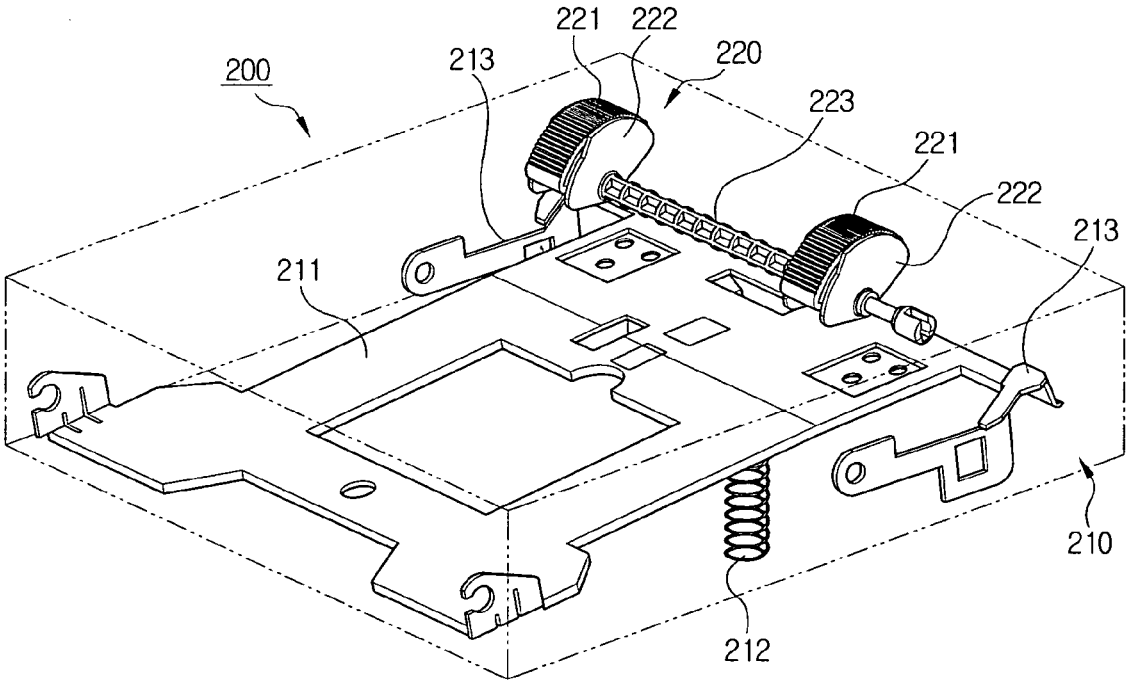
FIG. 5 is a perspective view of a printing media supply device in accordance with a first exemplary embodiment of the present invention.
Figure 6A:
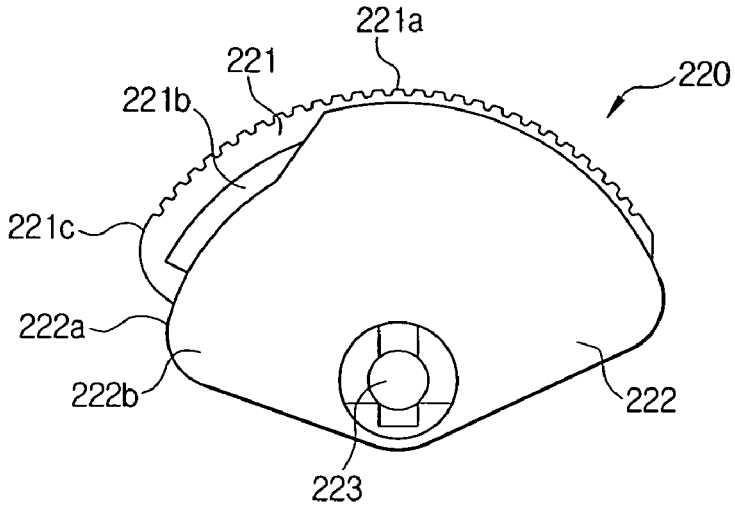
Figure 6B:
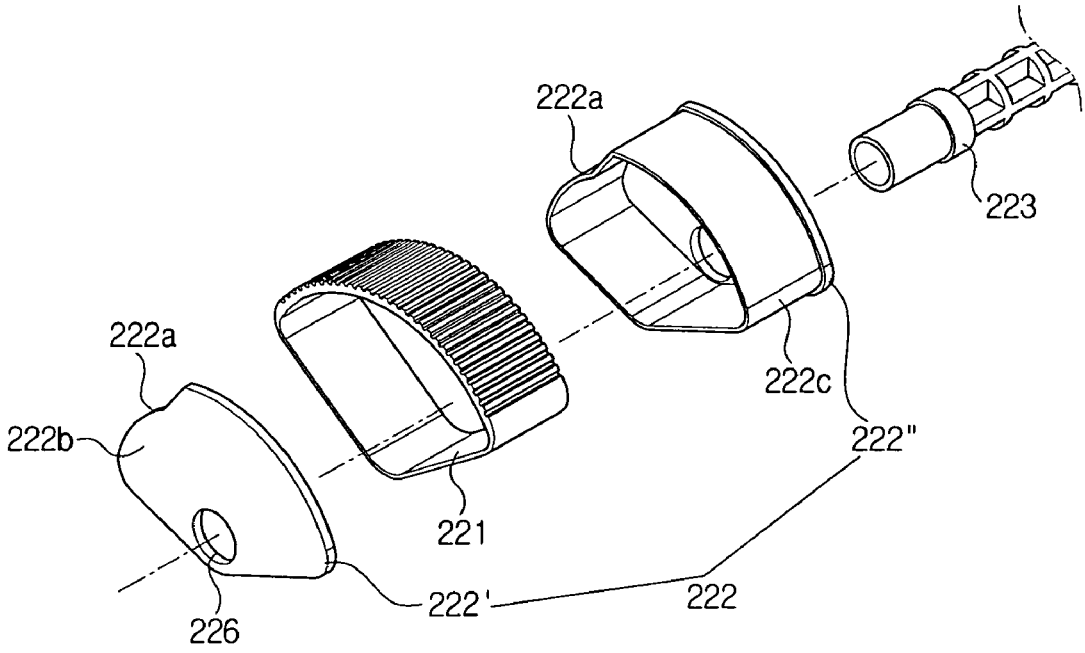
Figure 6C:
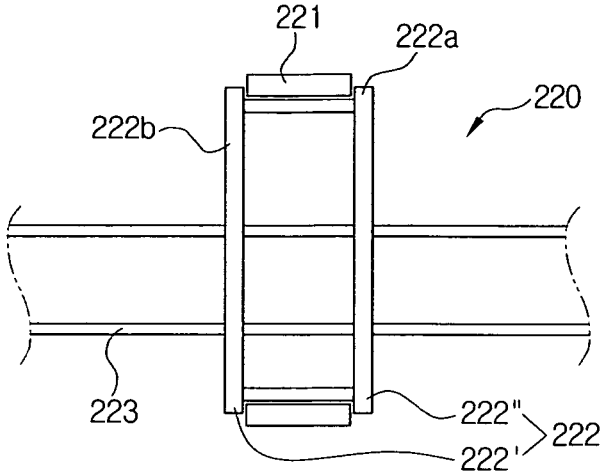

FIG. 5 is a perspective view of a printing media supply device in accordance with a first exemplary embodiment; and FIGS. 6A to 6C are detailed views of a pick-up roller of the printing media supply device of FIG. 5. FIG. 6A is a front view of the pick-up roller, FIG. 6B is an exploded perspective view of the pick-up roller and FIG. 6C is side view of the pick-up roller, in an assembled state.

Referring to the drawings, a printing media supply device 200 in accordance with a first exemplary embodiment of the present invention includes a printing media supply cassette 210 and a pick-up roller 220 with a buffer part for absorbing pressure from printing media, such as paper, fabric, film or the like, when picking up the printing media.

The printing media supply cassette 210 is detachably installed in a main body of the image forming apparatus. Components such as an image forming unit, a fusing unit, a printing media discharge unit are included in the main body of the image forming apparatus. Since the configuration of such components is well-known to those skilled in the art, a detailed description will be omitted for clarity and conciseness.

The printing media supply cassette 210 has a base plate 211, a first elastic member 212 and a finger 213. Printing media is stacked on the base plate 211, and the base plate 211 is installed a predetermined distance away from the pick-up roller 220. The first elastic member 212 pushes one side of the base plate 211 upward, so that the uppermost one of the printing media stacked on the base plate 211 is brought into a contact with the pick-up roller 220 when the pick-up roller 220 is rotated. The fingers 213 are linked with the base plate 211 so as to hinder forward movement of the printing media at the leading ends of the printing media, thereby separating the printing media and enabling the media to be supplied sheet by sheet.

The pick-up roller 220 picks up the printing media stacked in the printing media supply cassette 210, and then transfers the printing media into the main body of the image forming apparatus. To do so, the pick-up roller 220 has a pick-up member 221 and a rotation member 222, and is installed in an upper portion of the printing media supply cassette 210.

The pick-up member 221 transfers the printing media into the main body of the image forming apparatus by using frictional force generated when it is brought into contact with the printing media. A plurality of protrusions 221*a* may be formed along an outer circumferential surface of the pick-up member 221, as shown in FIG. 6A. The pick-up member 221 may be formed of a rubber material with a high frictional coefficient. In the first exemplary embodiment, the pick-up member 221 can be formed into a band shape so as to be supported by the support plate 222*c* of the rotation member 222. The pick-up member 221 formed in such a band shape can be mounted around a support plate 222*c* of the rotation member 222 to fasten it to the rotation member.

The rotation member 222 is disposed at both ends of the pick-up member 221 and the shape of the side of the rotation member corresponds to the shape of the pick-up member 221. The rotation member 222, together with the pick-up member 221, is coupled with a rotation shaft 223 through an opening 226 of the rotation member 222 to be rotatable relative to the main body of the image forming apparatus. The rotation member 222 can be formed integrally with the rotation shaft 223, or, for example, may be formed by assembling a pair of rotation members 222', 222". In the latter case, the rotation member 222 comprises a first rotation member 222' and a second rotation member 222", which are disposed to face each other. Any one of the rotation members 222' and 222" may be provided with the support plate 222*c* to support the pick-up member 221.

The radius of the rotation member 222 may be less than that of the pick-up member 221 so that it does not affect the contact of the pick-up member 221 with the printing media.

In the present exemplary embodiment, the rotation member 222 has a buffer surface 222*a* which is formed by cutting away a portion of a leading edge portion. The buffer surface 222*a* serves as a buffer part to absorb pressure from the printing media when the pick-up member 221 presses the printing media to pick up one sheet. The buffer surface 222*a* may be formed in the leading edge portion 222*b* of the rotation member 222, and exposes a side surface of the pick-up member 221 to the outside. The buffer surface 222*a* may be formed such that the side surfaces of the pick-up member 221 become more exposed when approaching the leading edge portion 221*c* of the pick-up roller 220. With the pick-up roller 220 configured like this, the pick-up member 221 absorbs the pressure from the printing media to a leading edge portion 221*c* of the pick-up member 221 when pressing the printing media.

As shown in FIG. 6A, a predetermined space 221*b* can be formed between the pick-up member 221 and the buffer surface 222*a* of the rotation member 222 near the leading edge portion 222*b* of the rotation member 222. As shown in FIG. 6B, the predetermined space 221*b* is a space between the support plate 222*c* of the rotation member 222 and an inner circumferential surface of the pick-up member 221 near the leading edge portion 222*b* of the rotation member 222. With this, it is possible to absorb more pressure from the printing media when the pick-up member 221 presses the printing media.

The shape of the pick-up member 221 is not limited to the just-described first exemplary embodiment, and can be formed of a variety of shapes.

Figure 7:
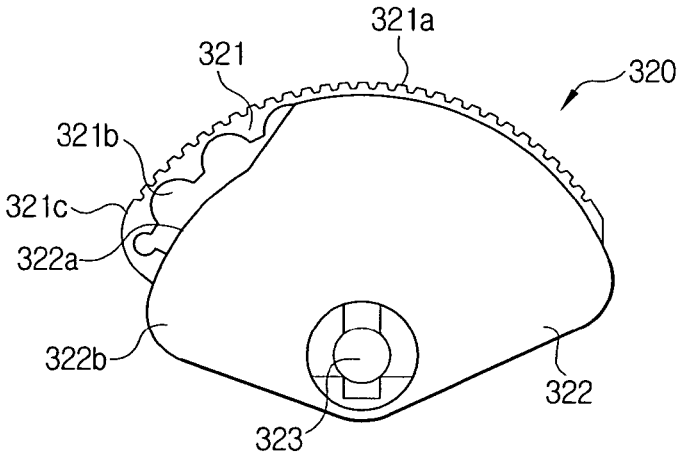
FIG. 7 is a front view of a pick-up roller in accordance with a second exemplary embodiment of the present invention.

FIG. 7 illustrates a front view of a pick-up roller 320 in accordance with a second exemplary embodiment of the present invention. The pick-up roller 320 in accordance with the second exemplary embodiment of the present invention is substantially identical to the pick-up roller 220 of the first exemplary embodiment, except for the shape of the pick-up member 321. Therefore, a detailed description of the pick-up roller will not be repeated.

Referring to FIG. 7, the pick-up member 321 of the pick-up roller 320 in accordance with the second exemplary embodiment is provided with an inner circumferential surface having a wavy shape. Further, a predetermined void 321*b* is formed between the pick-up member 321 and a buffer surface 322*a* of a rotation member 322 and near a leading edge portion 322*b* of the rotation member 322. In the pick-up member 321 with this configuration, since thick and thin portions are formed together, the capability of the pick-up member 321 to absorb pressure is less than that of the pick-up member 221 in accordance with the first exemplary embodiment. Therefore, in comparison with the pick-up roller 220 of the first exemplary embodiment, it may be more advantageous to use the pick-up roller 320 incorporating the pick-up member 321 in certain applications, such as when the pressure from the printing media is lower, or when there is less printing media.

Figure 8:
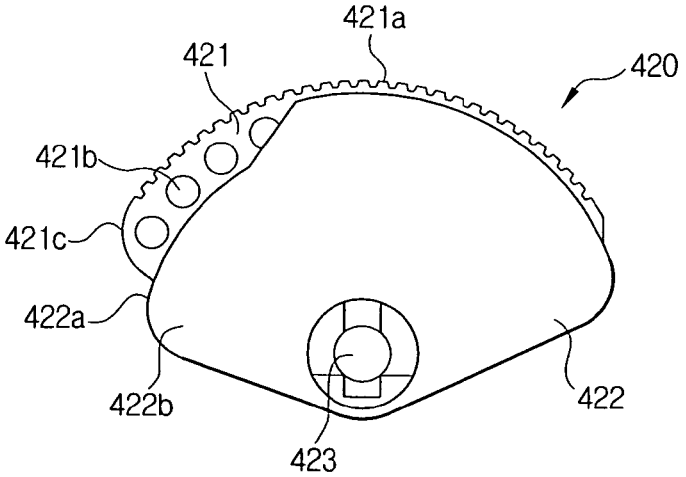
FIG. 8 is a front view of a pick-up roller in accordance with a third exemplary embodiment of the present invention.

FIG. 8 illustrates a front view of a pick-up roller 420 in accordance with a third exemplary embodiment of the present invention. The pick-up roller 420 in accordance with the third exemplary embodiment of the present invention is substantially identical to the pick-up roller 220 of the first exemplary embodiment, except for the shape of the pick-up member 421. Therefore, a detailed description of the pick-up roller will not be repeated.

Referring to FIG. 8, the pick-up member 421 of the pick-up roller 420 has a plurality of holes 421*b* formed therein. Further, instead of forming a void near a leading edge portion 422*b* of a rotation member 422, the pick-up member 421 and the buffer surface 422*a* of the rotation member 422 contact each other. In the pick-up member 421 with this configuration, since the pick-up member 421 contacts the buffer surface 422*a* of the rotation member 422 and has a plurality of holes 421*b*, the capability of the pick-up member 421 to absorb pressure is greater than that of the pick-up member 221 of the first exemplary embodiment. Therefore, in comparison with the pick-up roller 220 of the first exemplary embodiment, it may be more advantageous to use the pick-up roller 420 incorporating the pick-up member 421 in certain applications, such as when the pressure from the printing media is higher, or when there is more printing media.

Thus, the pick-up rollers of the first to third exemplary embodiment absorb different amounts of pressure from the printing media, even though they have buffer surfaces with the same shape. For example, if a printing media supply device equipped with the pick-up member in accordance with the first exemplary embodiment operates optimally when about 250 sheets of printing media are stacked therein, a printing media supply device equipped with the pick-up member in accordance with the second (or the third) exemplary embodiment may operate optimally when about 100 (or 500) sheets of printing media are stacked therein.

The operation of the printing media supply device for use in an image forming apparatus with the above-described configuration, in accordance with the first exemplary embodiment of the present invention, will now be described with reference to FIGS. 9A and 9B.

Figure 9A:
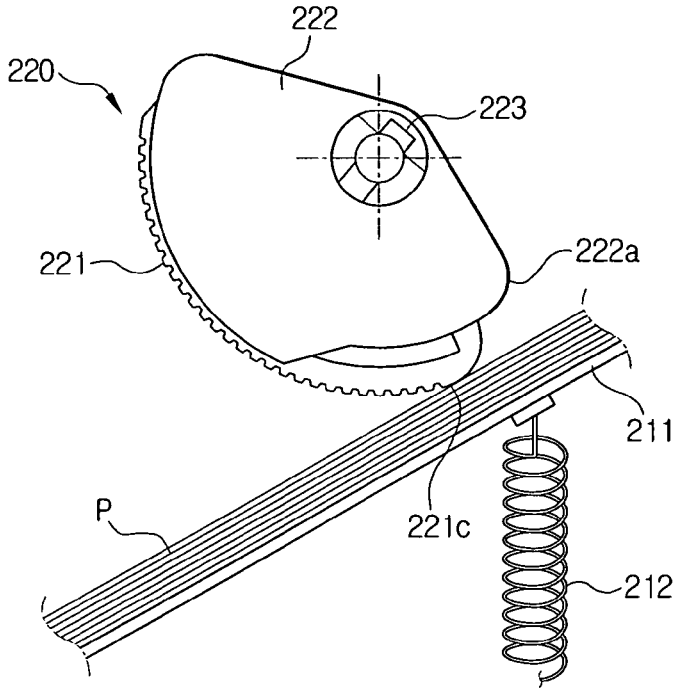
Figure 9B:
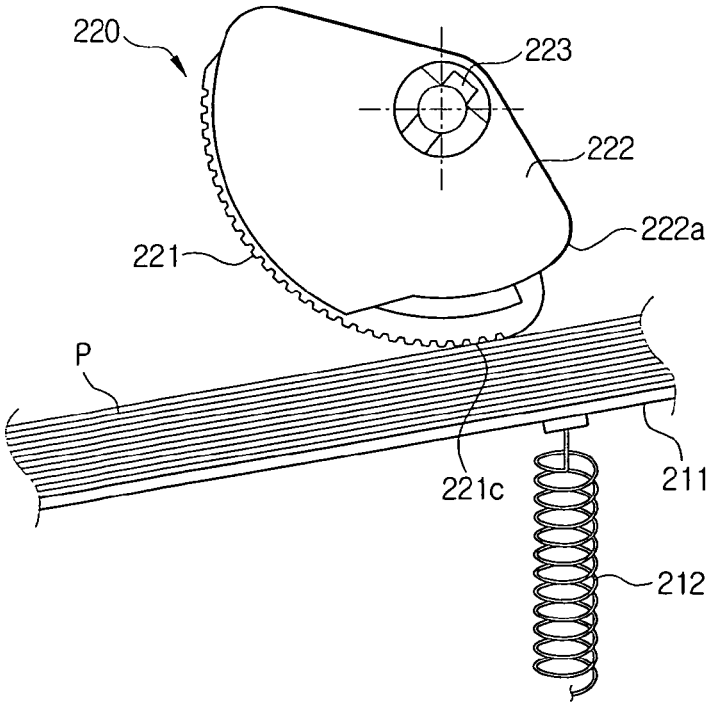

FIGS. 9A and 9B are front views showing the operation of the pick-up roller in accordance with the first exemplary embodiment of the present invention, wherein FIG. 9A illustrates a situation where there is a small amount of printing media and FIG. 9B illustrates a situation where there is a large amount of printing media.

As shown in FIGS. 9A and 9B, when a signal to pick up a printing media P is received from the image forming apparatus, the pick-up roller 220 rotates about the rotation shaft 223 counterclockwise. By the counterclockwise rotation of the pick-up roller 220, the leading edge portion 221*c* of the pick-up member 221 is brought into contact with a surface of the uppermost printing media P. Consequently, the printing media P is pressed down by the pick-up member 221.

At this time, the pressure pushing the printing media P upward by the first elastic member 212 is greater when there is a large amount of printing media P stacked in the base plate 211 (see FIG. 9B) than when there is a small amount of printing media P stacked in the base plate 211 (see FIG. 9A). Since the pick-up member 221 of the pick-up roller 220 is provided with the buffer surface 222*a*, the leading edge portion 221*c* of the pick-up member 221 can absorb pressure even when there is a large amount of printing media P. As a result, the pick-up member 221 can apply approximately uniform pressure to the printing media regardless of the amount of printing media, and thus the printing media P can be transferred sheet by sheet.

While the pick-up roller 220 is rotating counterclockwise, the pick-up member 221 presses the printing media P with the approximately uniform pressure and transfers the uppermost printing media P by a uniform frictional force to supply the printing media P into the main body of the image forming apparatus.

In the printing media supply device equipped with the pick-up roller 220 in accordance with the present invention, the printing media supply efficiency is improved since the printing media P is transferred with uniform pressure, even when a large quantity of printing media P is stacked in the printing media supply cassette. The printing media supply device equipped with the pick-up roller 320 (or 420) in accordance with the second (or third) exemplary embodiment operates substantially the same way as the printing media supply device equipped with the pick-up roller 220 in accordance with the first exemplary embodiment. Fourth Exemplary Embodiment A pick-up roller in accordance with a fourth exemplary embodiment of the present invention has the capability to absorb pressure by a different mechanism that of the first to third exemplary embodiments. FIGS. 10 and 11A to 11C illustrate such a printing media supply device.

Figure 10:
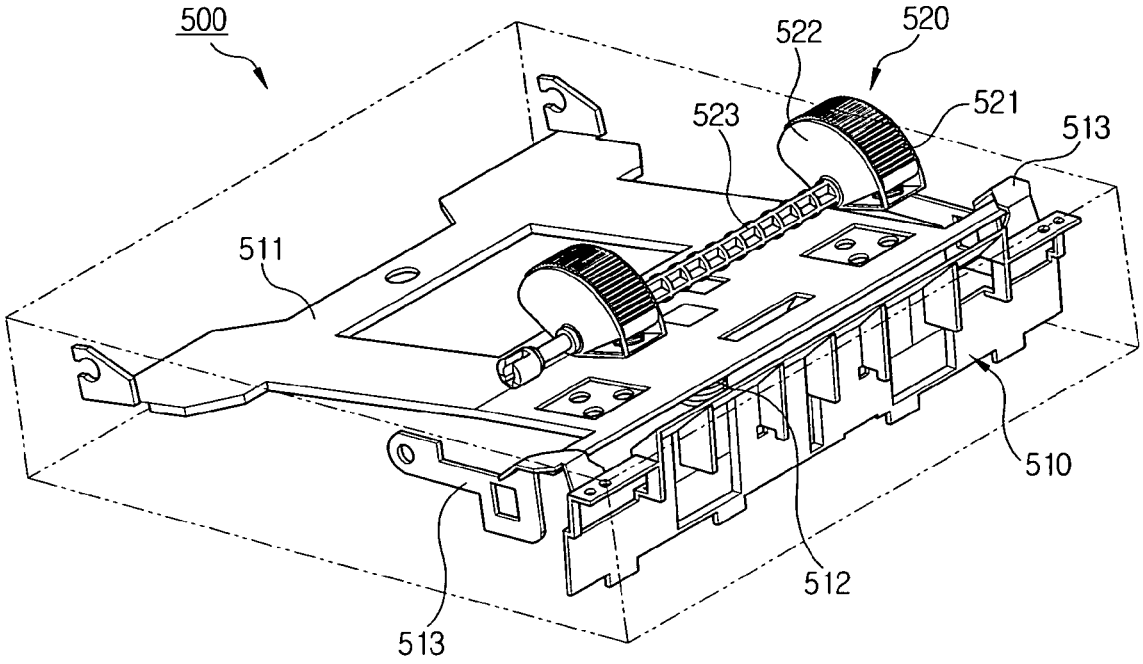
FIG. 10 is a perspective view of the printing media supply device in accordance with a fourth exemplary embodiment of the present invention.
Figure 11A:
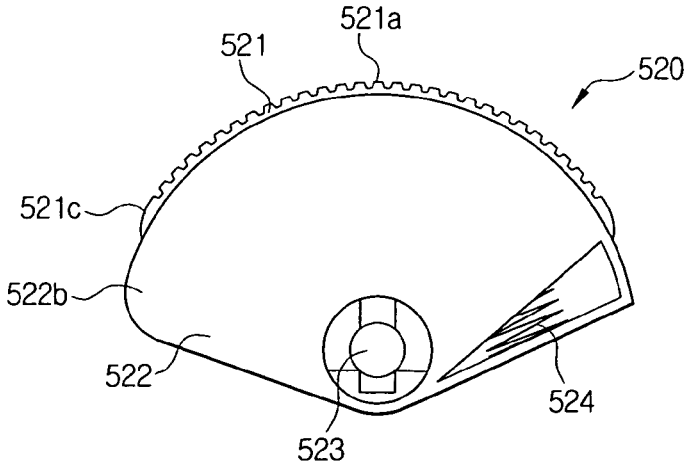
Figure 11B:
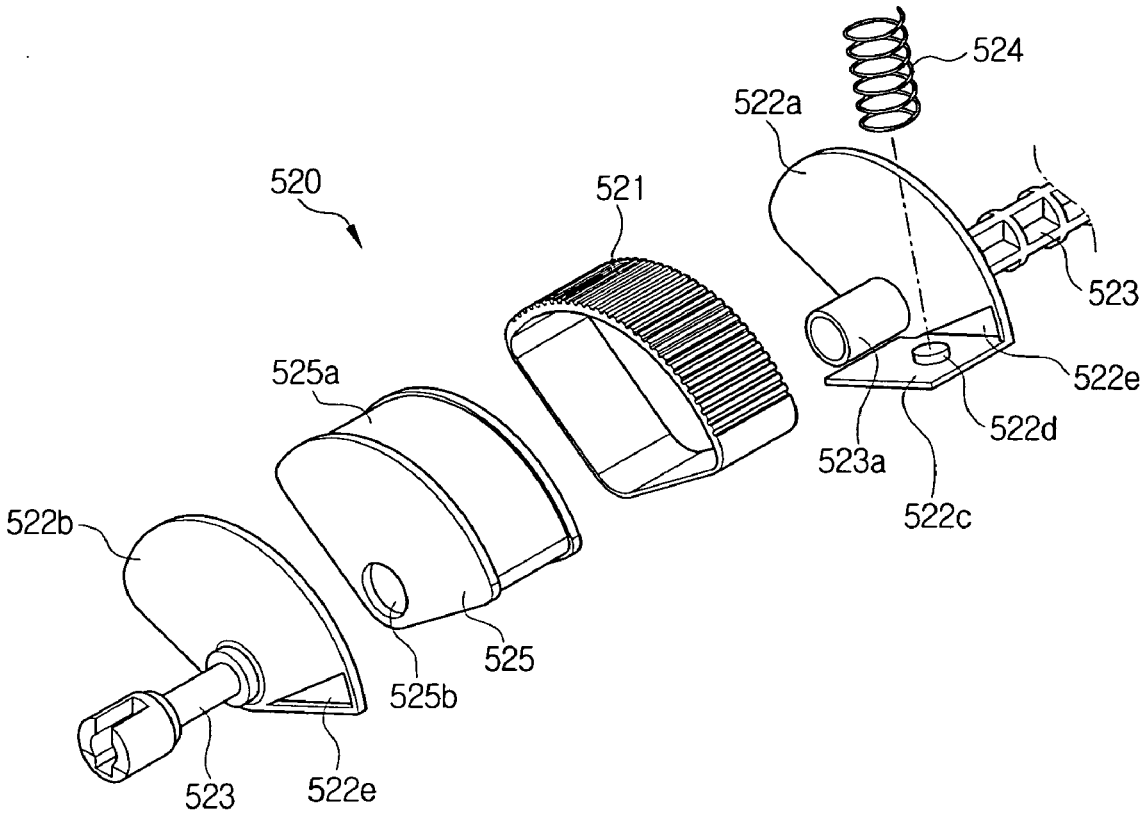
Figure 11C:
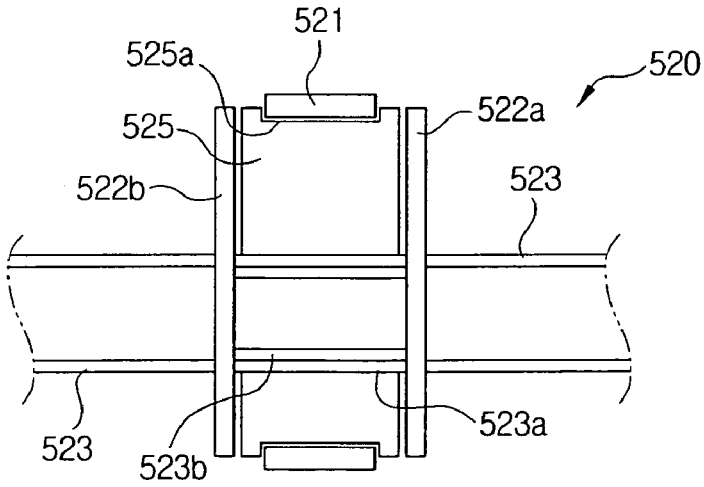

FIG. 10 is a perspective view of the printing media supply device in accordance with the fourth exemplary embodiment of the present invention, and FIGS. 11A to 11C are views illustrating the pick-up roller, wherein FIG. 11A is a front view of the pick-up roller, FIG. 11B is an exploded perspective view of the pick-up roller, and FIG. 11C is a side view of the pick-up roller in an assembled state.

Referring to the drawings, a printing media supply device 500 for use in an image forming device in accordance with the fourth exemplary embodiment of the present invention includes a printing media supply cassette 510 and a pick-up roller 520 with a buffer part for absorbing pressure from a printing media when picking up the printing media.

In the printing media supply device for use in an image forming apparatus in accordance with the fourth exemplary embodiment, the printing media supply cassette 510 is substantially identical to the printing media supply device of the first, second or third exemplary embodiments, so a detailed description will not be repeated. In the fourth exemplary embodiment, the pick-up roller pick-up roller 520 for absorbing pressure from the printing media when the printing media is picked up is configured as follows.

As shown in FIGS. 11A to 11C, the pick-up roller 520 in accordance with the fourth exemplary embodiment includes a pick-up member 521, a movable member 525 and a rotation member 522.

The pick-up member 521 for picking up the printing media has a substantially identical structure to that of the first exemplary embodiment. The pick-up member 521 can be mounted around an outer circumferential surface 525*a* of the movable member 525.

The movable member 525 supports the pick-up member 521 and is mounted around the rotation shaft 523. The movable member 525 may be mounted so that it is movable relative to the rotation shaft 523. Therefore, when the pick-up roller 520 is brought into contact with the printing media, the movable member 525 can be rotated in a direction opposite to that of the rotation member 522, so that pressure from the printing media can be absorbed by the movable member 525. Accordingly, the pick-up roller in accordance with the fourth exemplary embodiment can absorb pressure, like the pick-up rollers of the first, second or third exemplary embodiments which have a buffer surface in the leading edge portion of the rotation member.

The rotation member 522 is disposed at both sides of the movable member 525 and is mounted around the rotation shaft 523. The rotation member 522 may comprise a first rotation member 522*b* and a second rotation member 522*a*. The second rotation member 522*a* may face the first rotation member 522*b*. The second rotation member 522*a* is provided with a support plate 522*c* at its rear end portion so that a second elastic member 524 can be mounted on the support plate 522*c*. The support plate 522*c* may be provided with a protrusion part 522*d*, and the second elastic member 524 may be disposed about the protrusion part 522*d*. In the rear end portion of the rotation member 522, a cutaway portion 522*e* can be formed to facilitate rotation of the rotation member 522. The rotation shaft 523 is connected in the center portion of the rotation member 522. As shown in FIG. 11C, a leading end 523*a* of the rotation shaft 523 is axially connected to a through hole 525*b* of the movable member 525 such that the movable member 525 is rotatable relative to the rotation shaft 523.

If the movable member 525 is rotated backward about the rotation shaft 523 when the pick-up roller 520 is brought into contact with the printing media, the second elastic member 524 exerts an elastic force on the pick-up member 521 so as to return the movable member 525 back to its original position.

The operation of the fourth exemplary embodiment of the printing media supply device will now be described with reference to FIGS. 12A and 12B.

Figure 12A:
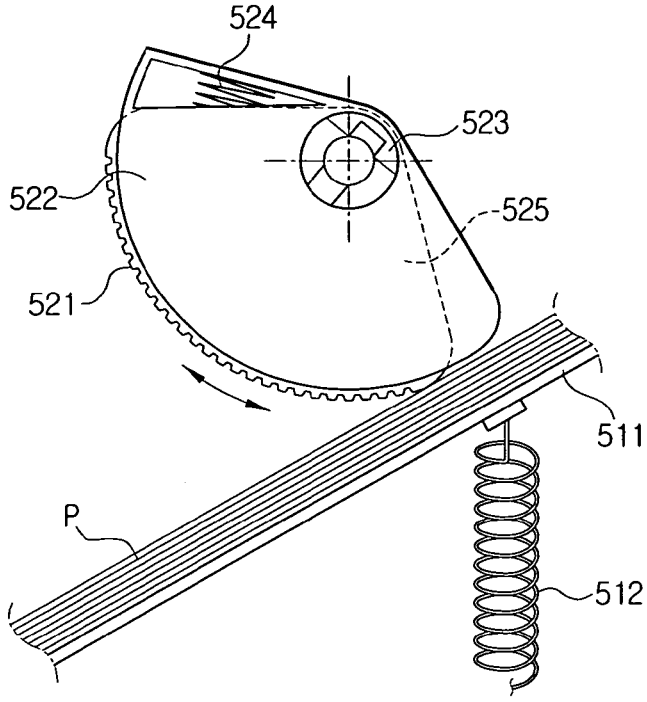
Figure 12B:
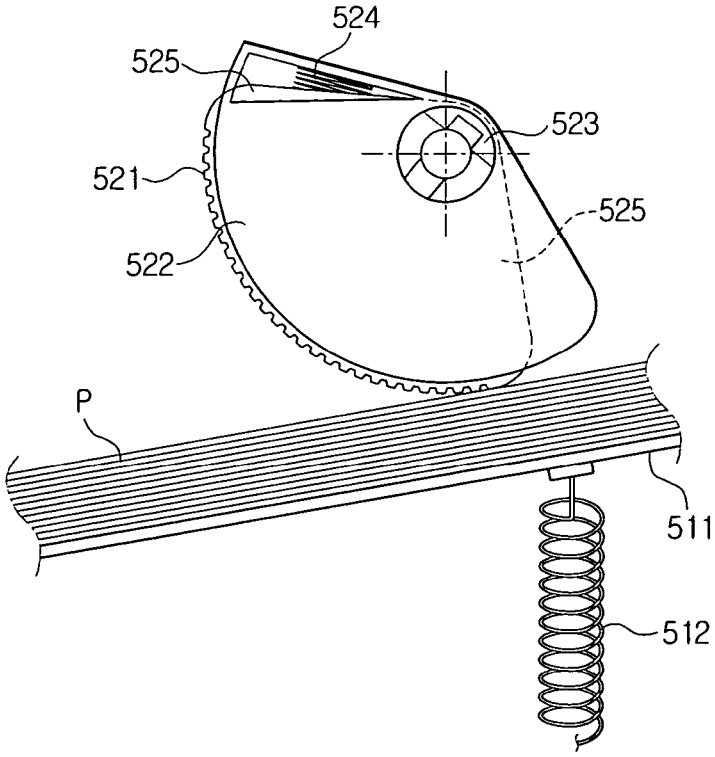

FIGS. 12A and 12B are front views illustrating the operation of the pick-up roller in accordance with the fourth exemplary embodiment, wherein FIG. 12A illustrates a situation where there is a small amount of printing media and FIG. 12B illustrates a situation where there is a large amount of printing media.

As shown in FIGS. 12A and 12B, when a signal to pick up the printing media P is received from the image forming apparatus, the pick-up roller 520 rotates about the rotation shaft 523 counterclockwise. When the pick-up roller 520 rotates counterclockwise, the leading edge portion of the pick-up member 521 is brought into contact with a surface of the uppermost printing media P. Then, the movable member 525 is rotated about the rotation shaft 523 clockwise a small amount, while the printing media P is pressed downwards by the pick-up member 521.

Similarly, in FIGS. 9A and 9B, at this time, the pressure pushing up the printing media P by the first elastic member 512 is greater when there is a large amount of printing media P stacked in the base plate 511 (see FIG. 12B) than when there is a small amount of printing media P stacked in the base plate 511 (see FIG. 12A). The pick-up member 521 of the pick-up roller 520 in accordance with the fourth exemplary embodiment of the present invention is mounted around the movable member 525, so the pick-up member 521 absorbs pressure due to the rotation of the movable member 525, even when there is a large amount of printing media P. As a result, the pick-up member 521 can apply approximately uniform pressure to the printing media regardless of the amount of printing media, and thus the printing media P can be stably transferred sheet by sheet.

While the pick-up roller 520 is rotating counterclockwise, the pick-up member 521 presses the printing media P with approximately uniform pressure and transfers the printing media P by a uniform frictional force to supply it into the main body of the image forming apparatus.

Accordingly, the pick-up roller 520 in accordance with the fourth exemplary embodiment has substantially the same capability to absorb pressure as the pick-up roller 220 (or 320 or 420) in accordance with the first (or second or third) exemplary embodiment. Further, since the printing media P are transferred by applying a uniform pressure even when there is a large amount of printing media P stacked on the printing media supply cassette, the printing media supply efficiency is improved.

As described above, the printing media supply device of the image forming apparatus in accordance with the present invention can maintain the pressure exerted on the printing media by the pick-up roller approximately uniform regardless of the amount of printing media to be picked up and supplied into the main body of the image forming apparatus. Therefore, even when there is a large amount of printing media stacked in the printing media supply device, the pickup roller can supply the printing media sheet by sheet, without multifeeding or crumpling.

Accordingly, since the printing media are supplied into the main body of the image forming apparatus by the pick-up roller without multifeeding and without being crumpled, the printing media supply efficiency can be improved. Further, the quality of images developed on the printing media is improved because of the improved printing media supply efficiency.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A printing media supply device for use in an image forming apparatus, comprising:

a printing media supply cassette capable of receiving stacked printing media, said printing media supply cassette comprises: a base plate for receiving stacked printing media, a first elastic member for pushing up one portion of the base plate, and at least one finger mounted on the base plate to hinder movement of the printing media so that the printing media is transferred sheet by sheet; and a pick-up roller adapted to pick up printing media stacked in the printing media supply cassette, the pick-up roller comprising:

a pick-up member for picking up the printing media;

a first rotation member having a planar shape with an outer edge defining a pick-up area, said outer edge having a recessed portion at a leading edge portion; and a second rotation member having a planar member parallel to said first rotation member and having a recessed portion at a leading edge portion, and a support plate extending from a side surface of the planar member, said support plate having an outwardly facing surface that supports the pick-up member and has a recessed portion at a leading edge portion, wherein the pick-up member surrounds said outwardly facing surface of the support plate, the support plate being radially spaced inwardly from said outer edge of said first rotation member and the outer edge of said second rotation member to define a recessed area to receive the pick-up member, the first and second rotation members being connected to a rotation shaft, the recessed area of the support plate, the recessed area of the first rotation member and the recessed area of the second rotation member define a buffer surface formed only at the leading edge portions where the pick-up member contacts the printing media, the buffer surface being spaced radially inward from an inner surface of the pick-up member and enabling the pick-up member to absorb pressure when the pick-up member contacts the printing media.

2. The printing media supply device according to claim 1, wherein the pick-up member comprises a plurality of protrusions formed along an outer circumferential surface of the pick-up member.

3. The printing media supply device according to claim 1, wherein the pick-up member comprises a rubber material.

4. The printing media supply device according to claim 1, wherein the pick-up member comprises a band.

5. The printing media supply device according to claim 1, wherein an inner circumferential surface of the pick-up member near a leading edge portion of the pick-up member comprises a wavy shape to form a space between the inner surface of the pick-up member and the buffer surface.

6. The printing media supply device according to claim 1, wherein the pick-up member comprises a void formed at a leading edge portion therein adjacent the buffer surface.

7. The printing media supply device according to claim 1, wherein the buffer surface is spaced from the pick-up member to expose side surfaces of the pick-up member.

8. The printing media supply device according to claim 7, wherein a space is formed between the pick-up member and the second rotation member near the leading edge portion of the second rotation member, whereby the pick-up member is spaced radially outward from the leading edge portion of the second rotation member.

9. The printing media supply device according to claim 7, wherein the buffer surface is formed such that side surfaces of the pick-up member become more exposed toward a leading edge portion of the pick-up roller and where a portion of the side surfaces of the pick-up member are covered by said first and second rotation members.

10. The printing media supply device according to claim 1, wherein the second rotation member is integral with the rotation shaft.

11. The printing media supply device according to claim 1, wherein the pick-up member is compressible and deformable at said leading edge portion of said second rotation member.

12. The printing media supply device according to claim 11, wherein said pick-up member has an inner edge spaced radially outward from the buffer surface.

13. The printing media supply device according to claim 12, wherein said inner surface of said pick-up member at said buffer surface has a plurality of spaced-apart recessed portions.

14. The printing media supply device according to claim 11, wherein said pick-up member includes a plurality of holes at said buffer surface.

15. The printing media supply device according to claim 1, wherein the buffer surface is the recessed portions formed in a leading edge of the outwardly facing surface of the support plate where the pick-up member compresses radially inward only in the region of the recessed portions when the leading edge contacts the printing media.

16. A printing media supply device for use in an image forming apparatus, comprising:

a printing media supply cassette capable of receiving stacked printing media; and a pick-up roller adapted to pick up printing media stacked in the printing media supply cassette, the pick-up roller comprising:

a pick-up member for picking up the printing media; and a rotation member having a support plate extending from a side surface of the rotation member, the pick-up member being supported on an outer support surface of the rotation member and surrounds the outer support surface of the rotation member, the rotation member being connected to a rotation shaft, the rotation member comprising a first rotation member having a planar shape with an outer edge spaced outwardly from said outer support surface, said outer edge having a recessed portion at a leading edge portion, and a second rotation member having an outer edge spaced outwardly from said outer support surface and having a recessed portion at a leading edge portion, said support plate extending from the side surface of said rotation member, said outer edges of said first and second rotation members defining a recess for receiving said pick-up member, the outer support surface of the rotation member having a recessed portion, the recessed portion of the support surface, the recessed portion of the first rotation member and the recessed portion of the second rotation member defining a buffer surface formed only at the leading edge portions where the pick-up member contacts the printing media, wherein the pick-up member is spaced outwardly from the buffer surface to absorb pressure at the buffer surface when the pick-up member contacts the printing media in the supply cassette and picks up the printing media.

17. The printing media supply device according to claim 16, wherein the buffer surface is spaced radially inwardly from an inner surface of the pick-up member, whereby the pick-up member is deformable toward the buffer surface when the pick-up roller contacts the printing media.

18. The printing media supply device according to claim 16, wherein the recessed portions are formed in the outer surfaces of the first and second rotation members and where the pick-up member compresses radially inward only in the region of the recessed portions when leading edge of the pick-up member contacts the printing media.

* * * * *